US007323813B2

(12) United States Patent
Watanabe et al.

(10) Patent No.: US 7,323,813 B2
(45) Date of Patent: Jan. 29, 2008

(54) CATHODE RAY TUBE

(75) Inventors: Kenichi Watanabe, Ootakii (JP); Kazunari Noguchi, Chiba (JP); Hiroshi Takanobu, Mobara (JP)

(73) Assignee: Hitachi, Ltd., Tokyo (JP)

( * ) Notice: Subject to any disclaimer, the term of this patent is extended or adjusted under 35 U.S.C. 154(b) by 42 days.

(21) Appl. No.: 11/233,158

(22) Filed: Sep. 22, 2005

(65) Prior Publication Data

US 2006/0087213 A1 Apr. 27, 2006

(30) Foreign Application Priority Data

Sep. 28, 2004 (JP) ..... 2004-281851

(51) Int. Cl.
*H01J 29/46* (2006.01)

(52) U.S. Cl. ..... 313/449

(58) Field of Classification Search ..... 313/414, 313/441, 409, 449
See application file for complete search history.

(56) References Cited

U.S. PATENT DOCUMENTS 5,798,603 A * 8/1998 Tsuruoka et al. ..... 313/412
5,808,406 A * 9/1998 Choi ..... 313/412
6,329,747 B1 * 12/2001 Noguchi et al. ..... 313/414

* cited by examiner

*Primary Examiner*—Vip Patel
(74) *Attorney, Agent, or Firm*—Milbank, Tweed, Hadley & McCloy LLP

(57) ABSTRACT

Assuming an aperture diameter of an electron beam aperture formed in a shield cup as Vsc, an aperture diameter of an electron beam aperture formed in an inner electrode of a focusing electrode as V5, and a distance between the electron beam aperture formed in the shield cup and the inner electrode as L, the above-mentioned aperture diameter Vsc, the aperture diameter V5 and the distance L are determined to satisfy $\tan\theta=(V5-Vsc)/2L\geqq 0.08$. Due to such a constitution, it is possible to enhance the degree of vacuum in the inside of a cathode ray tube and, it is possible to prevent a getter for elevating the degree of vacuum in the inside of the cathode ray tube and for maintaining the elevated degree of the vacuum from being scattered to the electron gun side thus preventing the deterioration of the characteristics of the electron gun.

1 Claim, 4 Drawing Sheets

CATHODE RAY TUBE

CROSS-REFERENCE TO RELATED APPLICATION

The present application claims priority from Japanese application JP2004-281851 filed on Sep. 28, 2004, the content of which is hereby incorporated by reference into this application

BACKGROUND OF THE INVENTION

1. Field of the Invention

The present invention relates to a cathode ray tube including an electron gun for generating electron beams to display an image, and more particularly to a cathode ray tube which prevents a getter which is served for increasing a degree of vacuum in the inside of the cathode ray tube and for maintaining the degree of vacuum from being scattered to an electron gun side and deteriorating characteristics of the electron gun.

2. Description of the Related Art

For increasing the degree of vacuum in the inside of the cathode ray tube and for maintaining the degree of vacuum over a long period, it is necessary to scatter the getter in the inside of the cathode ray tube. The getter is formed of a metal film made of barium Ba and is scattered over a wide range in the inside of the cathode ray tube to perform a function of absorbing a generated gas. However, when the metal film which originally possesses a low work function is scattered and adheres to electrodes of the electron gun, stray electrons are generated from the metal film. That is, a withstand voltage between electrodes of the electron gun is lowered. Further, phosphors emit light due to the stray electrons thus exerting an adverse influence to an image.

In Japanese Patent Laid-open 2001-93449, there is disclosed a color cathode ray tube in which a getter is arranged between a funnel and an inner shield arranged close to an inner surface of the funnel, a control plate which controls the scattering of a getter vapor from the getter in the direction other than the electron-gun direction is provided to the getter thus forming a getter film over a wide range without allowing the getter vapor to adhere to a color selection electrode and the electron gun.

BRIEF SUMMARY OF THE INVENTION

In the cathode ray tube, the getter is mounted on a distal end of an antenna which extends from the electron gun. In the electron gun with a shield cup having a large diameter and a large distance among three electron guns, barium (Ba) enters the inside of a focusing electrode G5 and hence, the getter is liable to become a source for generating stray electrons through minute flaws or the like.

In the cathode ray tube with a deflection angle of 100 degree or less, compared to the cathode ray tube with a deflection angle exceeding 100 degree, the direction along which the getter is scattered is relatively directed to the electron gun side. Accordingly, when the getter is scattered, barium Ba is liable to adhere to the inside of the electron gun. As a result, the withstand voltage characteristic of a fifth grid electrode is deteriorated.

Accordingly, it is an object of the present invention to provide a cathode ray tube which can prevent the deterioration of characteristics of an electron gun attributed to a getter.

The degree of influence attributed to the scattering of the getter differs depending on a length and an aperture diameter of an electron gun. To prevent the jumping of barium Ba, it is necessary to determine the relationship between the length of the electron gun, an aperture diameter of a focusing electrode G5 and an aperture diameter of a shield cup SC.

That is, assuming an aperture diameter of an electron beam aperture formed in a shield cup as Vsc, an aperture diameter of an electron beam aperture formed in an inner electrode as V5, and a distance between the electron beam aperture formed in the shield cup and the inner electrode as L, the above-mentioned aperture diameter Vsc, the aperture diameter V5 and the distance L are determined to satisfy a following formula.

$$\tan\theta=(V5-Vsc)/2L\geqq 0.08$$

By determining such a relationship, an area of focusing electrode G5 which can be observed from the panel side through the electron beam aperture formed in the shield cup SC can be reduced. That is, the adhesion of barium Ba to the focusing electrode G5 can be reduced.

According to the present invention, since the adhesion of barium Ba to the focusing electrode G5 can be reduced, the insufficient withstand voltage and the reproduction steps can be reduced in number whereby a manufacturing cost of the cathode ray tube can be reduced.

Further, the cathode ray tube according to the present invention is preferably applicable to a television set and a computer display device whose deflection angle is 100 degree or less, a distance between neighboring electron guns is large, the electron guns with electrodes having an elliptical aperture diameter are provided, and an antenna getter is provided to a distal end portion of the electron gun.

DETAILED DESCRIPTION OF THE INVENTION

Preferred embodiments of the present invention are explained hereinafter in conjunction with attached drawings.

Embodiment

Figure 1:
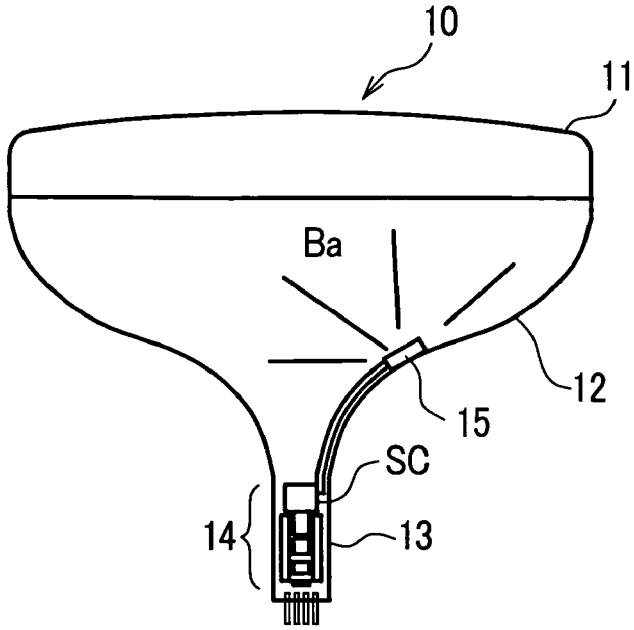
FIG. 1 is a schematic view of a 110-degree deflection cathode ray tube showing the getter scattering direction.
Figure 2:
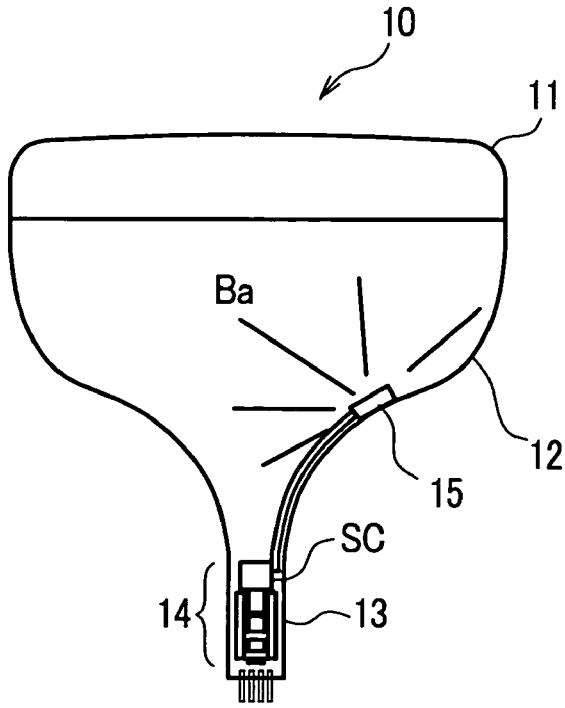
FIG. 2 is a schematic view of a 90-degree deflection cathode ray tube showing the getter scattering direction.

FIG. 1 is a conceptual view showing the difference between a deflection angle of a cathode ray tube and a getter scattering direction and also is a schematic view of a 110-degree deflection cathode ray tube whose deflection angle exceeds 100 degree, for example. FIG. 2 is a schematic view of a 90-degree deflection cathode ray tube having a deflection angle of 100 degree or less, for example, which constitutes an object of the present invention.

In FIG. 1 and FIG. 2, the cathode ray tube 10 is constituted of a face plate 11, a funnel 12 and a neck portion 13 and the inside thereof which is surrounded by these parts is held in a vacuum. In the inside of the cathode ray tube 10, an antenna getter 15 which is mounted on a shield cup SC of an electron gun 14 is provided.

With respect to barium Ba which is scattered from the antenna getter 15, in case of the 110-degree deflection cathode ray tube shown in FIG. 1, the probability that the barium Ba adheres to the electron gun 14 is small. However, in the case of the 90-degree deflection cathode ray tube shown in FIG. 2, as indicated by an arrow, the probability that barium Ba adheres to the electron gun 14 is increased. Accordingly, the smaller an inclination angle, barium Ba is liable to enter the electron gun 14.

Figure 3:
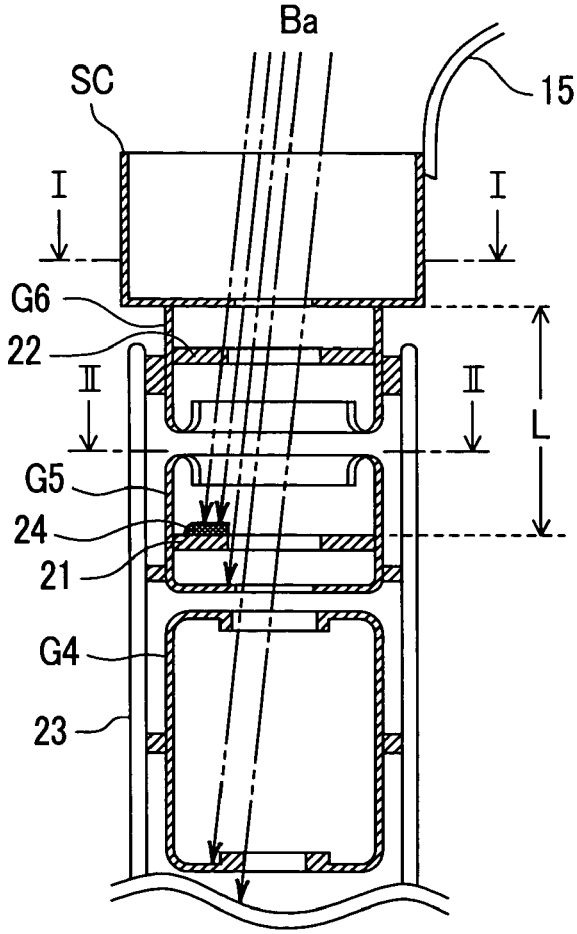
FIG. 3 is a schematic view of an electron gun showing a state in which barium Ba in the inside of the electron gun is scattered.
Figure 4:
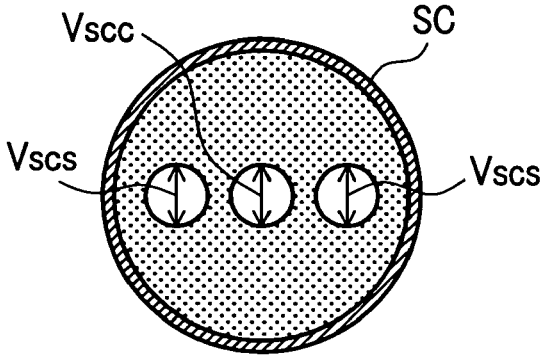
FIG. 4 is a cross-sectional view taken along a line I-I in FIG. 3.

FIG. 3 is an explanatory view showing a state in which barium Ba adheres to the electrode in the inside of the electron gun 14 and also is an enlarged view of a portion of the electron gun 14. FIG. 4 is a view of the shield cup SC shown in FIG. 3 as viewed from a line I-I, and FIG. 5 is a view of a focusing electrode G5 shown in FIG. 3 as viewed from a line II-II.

The electron gun shown in FIG. 3 includes, although not shown in the drawing, an electron beam generating part which is constituted of three cathodes which are disposed in an in-line arrangement, that is, a first grid electrode G1, a second grid electrode G2 and a third grid electrode G3. On a stage behind the electron beam generating part, a fourth grid electrode G4, the fifth grid electrode (focusing electrode) G5, a sixth grid electrode (final electrode) G6 and the shield cup SC are arranged. These electrodes are arranged at a given interval toward a phosphor screen which is formed on the face plate 11. Here, these electrodes are supported by a beading glass 23. In the inside of the fifth grid electrode (focusing electrode) G5 and the inside of the sixth grid electrode G6, inner electrodes 21, 22 are respectively provided.

Figure 5:
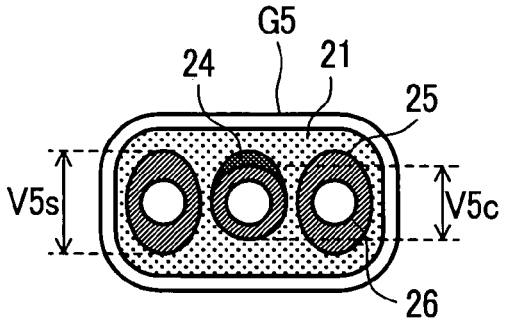
FIG. 5 is a cross-sectional view taken along a line II-II in FIG. 3.

In FIG. 3, FIG. 4 and FIG. 5, barium Ba which is scattered from the antenna getter is adhered to the focusing electrode G5, the inner electrode 21 of the focusing electrode G5 and the fourth grid electrode G4 and, at the same time, barium Ba passes through the fourth grid electrode G4 and also adheres to the third grid electrode G3 in the electron beam generating part. Here, barium Ba which adheres to the inner electrode 21 of the focusing electrode G5 is indicated by symbol 24 particularly.

In FIG. 4, an aperture diameter Vscc of the center electron beam aperture formed in the shield cup SC and an aperture diameter Vscs of both side electron beam apertures formed in the shield cup SC are indicated. These aperture diameters are diameters in the vertical direction as viewed from the electron beam scanning direction. In the drawing, since the electron beam apertures have a circular shape, diameters of these electron beam apertures in the horizontal direction are equal to diameters of the apertures in the vertical direction.

In FIG. 5, an aperture diameter V5*c* of the center electron beam aperture formed in the inner electrode 21 of the focusing electrode G5 and an aperture diameter V5*s* of both side electron beam apertures 25 formed in the inner electrode 21 are indicated. These aperture diameters are diameters in the vertical direction as viewed from the electron beam scanning direction. In the drawing, the center electron beam aperture has a circular shape and the side electron beam apertures have an elliptical shape. Here, symbol 26 indicates the electron beam aperture of the focusing electrode G5. Further, symbol 24 indicates the adhered barium Ba. Here, Vsc is a general term of the electron beam aperture diameter of the shield cup SC, while V5 is a general term of the aperture diameter of the inner electrode of the focusing electrode G5.

As can be understood from above, it is important to properly decrease the aperture diameter Vsc of the electron beam aperture formed in the shield cup SC corresponding to the positional relationship L between the shield cup SC and the inner electrode 21 of the focusing electrode G5.

Figure 6:
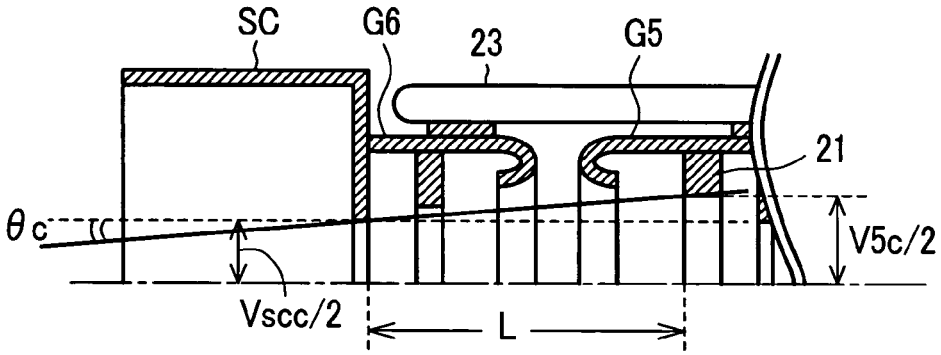
FIG. 6 is an explanatory view showing a positional relationship between an aperture diameter formed in a shield cup SC and an aperture diameter formed in an inner electrode 21 (center electron gun)
Figure 7:
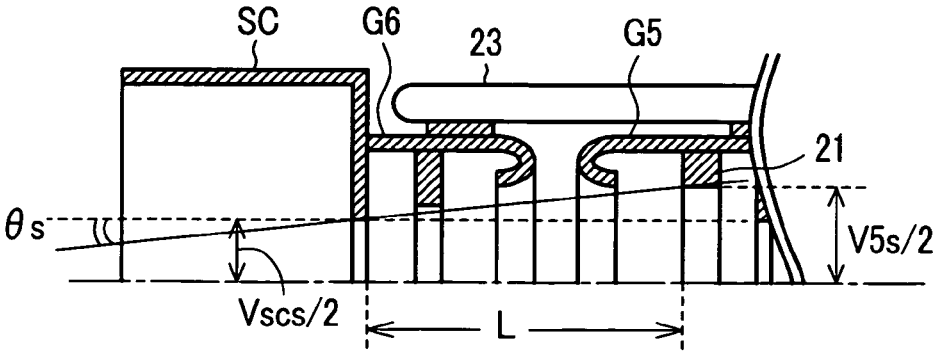
FIG. 7 is an explanatory view showing a positional relationship between an aperture diameter formed in a shield cup SC and an aperture diameter formed in an inner electrode 21 (side electron gun)

FIG. 6 and FIG. 7 are explanatory views showing the aperture diameter V5 of the electron beam apertures formed in the inner electrode 21 of the focusing electrode G5, the aperture diameter Vsc of the electron beam aperture formed in the shield cup SC, and the positional relationship between the electron beam aperture formed in the inner electrode 21 of the focusing electrode G5 and the electron beam aperture formed in the shield cup SC. FIG. 6 is a cross-sectional view of the center electron gun, while FIG. 7 is a cross-sectional view of the side electron gun. These drawings are respectively explanatory views showing the positional relationship between panel-side end portions of the electron beam apertures formed in the inner electrode 21 and cathode-side end portions of the electron beam apertures formed in the shield cup.

FIG. 6 shows the relationship between the electron beam apertures formed in the shield cup SC of the center electron gun and the electron beam apertures formed in the inner electrode 21 of the focusing electrode G5 using an angle θc. As a result, it is found that the larger the angle θc, the adhesion of barium Ba can be reduced.

In the same manner as FIG. 6, FIG. 7 shows the relationship between the electron beam apertures formed in the shield cup SC of the side electron guns and the electron beam apertures formed in the inner electrode 21 of the focusing electrode G5 using an angle θs. As a result, it is found that the larger the angle θs, the adhesion of barium Ba can be reduced.

As can be understood from above, by increasing the aperture diameter V5 of the inner electrode 21 of the focusing electrode G5, by decreasing the aperture diameter Vsc of the shield cup SC or by setting the positional relationship L to a small value, the adhesion of the barium Ba can be reduced.

The aperture diameter V5 of the inner electrode 21 of the focusing electrode G5 and the size L are determined to obtain the given focusing characteristic and it is desirable to adjust the aperture diameter V5 and the size L using the aperture diameter Vsc of the shield cup SC.

FIG. 8 to FIG. 11 are explanatory views showing the relationship between the aperture diameter Vsc of the shield cup SC and the aperture diameter V5 of the inner electrode 21 of the focusing electrode G5, and show embodiments when the aperture diameter Vsc of the shield cup SC and the aperture diameter V5 of the inner electrode 21 of the focusing electrode G5 are made different from each other.

Figure 8:
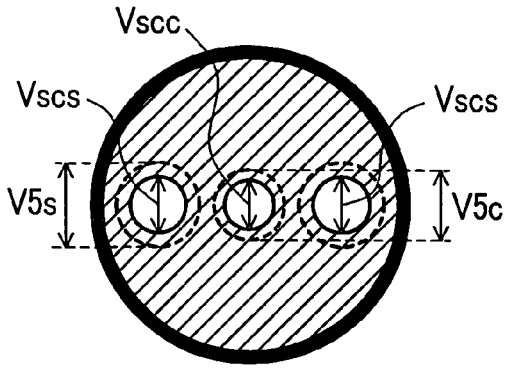
FIG. 8 is an explanatory view showing a relationship between an aperture diameter formed in a shield cup SC and an aperture diameter formed in an inner electrode 21.

FIG. 8 shows one embodiment of the electron gun in which, as shown in an embodiment 1 on a following table 1, the aperture diameter Vscc of the center electron beam aperture formed in the shield cup SC is set to 4.5 mm, the aperture diameter Vscs of both side electron beam apertures formed in the shield cup SC is set to 5.5 mm, the aperture diameter V5*c* of the center electron beam aperture formed in the inner electrode 21 of the focusing electrode G5 is set to 6.3 mm, the aperture diameter V5*s* of both side electron beam apertures formed in the inner electrode 21 of the focusing electrode G5 is set to 7.8 mm, and the distance L between the shield cup SC and the inner electrode 21 of the focusing electrode G5 is set to 10.7 mm.

Provided that tan θ=(V5−Vsc)/2L, to obtain tan θc=(V5*c*−Vscc)/2L of the center electron gun and tan θs=(V5*s*−Vscs)/2L of both side electron guns respectively from these numerical values, tan θc and tan θs take values shown in the embodiment 1 on following Table 1.

Figure 9:
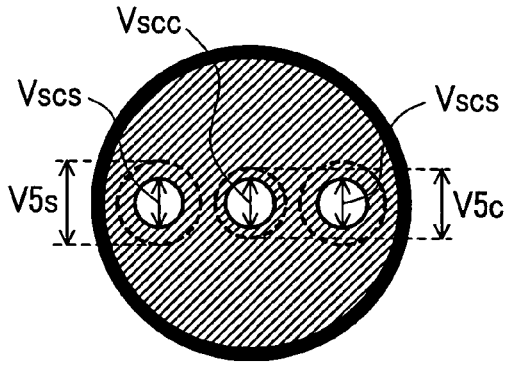
FIG. 9 is an explanatory view showing a relationship between an aperture diameter formed in a shield cup SC and an aperture diameter formed in an inner electrode 21.
Figure 10:
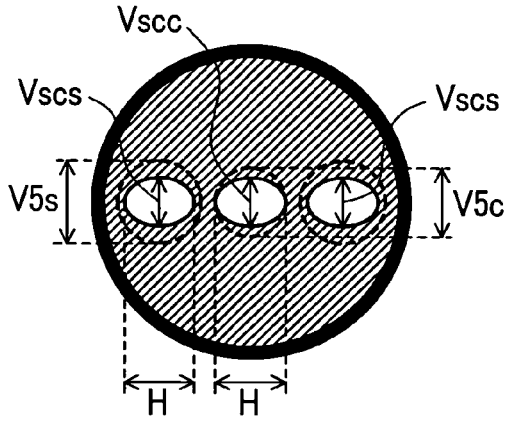
FIG. 10 is an explanatory view showing a relationship between an aperture diameter formed in a shield cup SC and an aperture diameter formed in an inner electrode 21.
Figure 11:
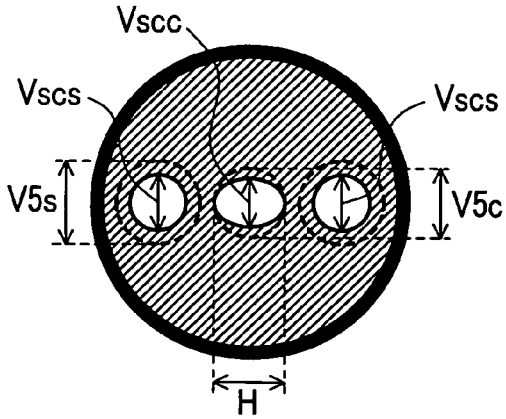
FIG. 11 is an explanatory view showing a relationship between an aperture diameter formed in a shield cup SC and an aperture diameter formed in an inner electrode 21.

In the same manner, FIG. 9 to FIG. 11 respectively correspond to embodiment 2 to embodiment 4 of following Table 1. However, in FIG. 10, the aperture diameter H in the horizontal direction of the shield cup SC is set to 5.0 mm with respect to the center electron beam aperture as well as both side electron beam apertures and shapes of these apertures are formed in an elliptical shape. Further, in FIG. 11, the aperture diameter H in the horizontal direction of the center electron beam aperture formed in the shield cup SC is set to 5.0 mm and the shape of the aperture is formed in an elliptical shape.

TABLE 1

| | embodiment 1 | embodiment 2 | embodiment 3 | embodiment 4 |
|---|---|---|---|---|
| Vscc | 4.5 | 4.0 | 4.0 | 4.0 |
| Vscs | 5.5 | 4.0 | 4.0 | 4.5 |
| V5c | 6.3 | 6.3 | 6.2 | 6.3 |
| V5s | 7.8 | 7.8 | 7.6 | 7.8 |
| L | 10.7 | 10.7 | 10.7 | 10.7 |
| tanθc | 0.08 | 0.11 | 0.10 | 0.11 |
| tanθs | 0.11 | 0.18 | 0.17 | 0.16 |

As can be understood from Table 1, by setting tan θc to 0.08 or more and by setting tan θs to 0.11 or more, it is possible to freely determine the center electron gun and both side electron guns within a range that the focusing characteristic is not influenced.

The present invention is effectively applicable to the cathode ray tube in which the distance (hereinafter referred to as "S size") between the neighboring electron guns is large. In the electron gun adopting the in-line arrangement, when the S size becomes small, the concentration angle between the center electron beam and the side electron beams in the electron beam apertures formed in the shadow mask becomes small.

Accordingly, when the S size is small, it is necessary to increase the distance between the shadow mask and the phosphor screen. When the distance between the shadow mask and the phosphor screen is increased, the electron beams are liable to be affected by magnetic noises (particularly, earth magnetism) from the outside between the shadow mask and the phosphor screen. As a result, even when the color cathode ray tube is directed in one direction so as to perform the adjustment to allow the electron beams to land on the correct positions, when the color cathode ray tube is directed in other direction, the color cathode ray tube is affected by the different earth magnetism and hence, the electron beams are moved whereby the electron beams cannot be landed at accurate positions thus deteriorating the color purity of the color cathode ray tube.

On the other hand, when the large S size is set, the concentration angle between the center electron beam and the side electron beams in the electron beam aperture of the shadow mask is increased. Accordingly, even when the distance between the shadow mask and the phosphor screen becomes short, there exists no possibility that the electron beams impinge on the phosphor other than the desired phosphor. Since the distance between the shadow mask and the phosphor screen can be made small, it is possible to reduce the influence of the magnetic noises (particularly, the earth magnetism) from the outside between the shadow mask and the phosphor screen. As the result, it is possible to suppress the deterioration of color purity which occurs when the direction of the color cathode ray tube is changed.

Further, in the electron gun in which the S size increases, three beam apertures are spaced apart from each other and hence, the aperture diameter of the fifth grid electrode 5 can be increased. By increasing the aperture diameter of the electrode, the electron beams hardly impinge on the electrodes. Along with the increase of the aperture diameter of the fifth grid electrode, the aperture of the shield cup is also increased.

In case of the cathode ray tube having the neck outer diameter of 29 mm, in the electron gun provided with a cylindrical lens having a diameter of approximately 5.5 mm through which three electron beams pass therethrough independently in the main lens part, the S size is set to 6.6 mm. Further, although there exists a color cathode ray tube in which the S size is set to a value which falls within a range of 4.75 to 5.5 mm, in this embodiment, the S size is set to 6.6 mm.

In this manner, in the electron gun with the shield cup having the large aperture diameter, the getter is liable to be scattered in the cathode direction and hence, the present invention exhibits the remarkable advantageous effects in controlling the getter.

What is claimed:

1. A cathode ray tube having an electron gun which includes at least three cathodes which are disposed in an in-line arrangement, a first grid electrode, a second grid electrode, a third grid electrode, a fourth grid electrode, a focusing electrode having an inner electrode, a final electrode, and a shield cup which is arranged on a face plate side of the final electrode, and an antenna getter mounted on the shield cup, the electron gun emitting a center electron beam and two side electron beams which are arranged to sandwich the center electron beam therebetween, assuming an aperture diameter of the center electron beam aperture formed in the shield cup as Vscc, an aperture diameter of the center electron beam aperture formed in an inner electrode as V5*c*, and a distance between the electron beam aperture formed in the shield cup and the inner electrode as L, a relationship $\tan \theta c=(V5c-Vscc)/2L \geqq 0.08$ is established, and assuming an aperture diameter of a side electron beam aperture formed in a shield cup as Vscs, an aperture diameter of side electron beam aperture formed in an inner electrode as V5*s*, and a distance between the electron beam aperture formed in the shield cup and the inner electrode as L, a relationship $\tan \theta=(V5s-Vscs)/2L \geqq 0.11$ is established.

* * * * *